US007182807B2

(12) United States Patent
van Ooij et al.

(10) Patent No.: US 7,182,807 B2
(45) Date of Patent: Feb. 27, 2007

(54) SILANE COATINGS FOR METAL

(75) Inventors: Wim J. van Ooij, Fairfield, OH (US); Wei Yuan, Northbrook, IL (US)

(73) Assignee: University of Cincinnati, Cincinnati, OH (US)

( * ) Notice: Subject to any disclaimer, the term of this patent is extended or adjusted under 35 U.S.C. 154(b) by 0 days.

(21) Appl. No.: 10/947,948

(22) Filed: Sep. 23, 2004

(65) Prior Publication Data

US 2005/0058843 A1 Mar. 17, 2005

Related U.S. Application Data

(62) Division of application No. 09/356,926, filed on Jul. 19, 1999, now Pat. No. 6,827,981.

(51) Int. Cl.
*C09D 183/07* (2006.01)

(52) U.S. Cl. ..... 106/287.11; 428/447

(58) Field of Classification Search ..... 106/287.11; 428/447

See application file for complete search history.

(56) References Cited

U.S. PATENT DOCUMENTS

| | | | | |
|---|---|---|---|---|
| 5,622,782 | A * | 4/1997 | Poutasse et al. | 428/344 |
| 5,939,353 | A * | 8/1999 | Bhattacharyya et al. | 423/600 |
| 6,071,566 | A * | 6/2000 | Brown et al. | 427/387 |
| 6,409,874 | B1 * | 6/2002 | Van Der Aar et al. | 156/314 |

* cited by examiner

*Primary Examiner*—Margaret G. Moore
(74) *Attorney, Agent, or Firm*—Dinsmore & Shohl LLP

(57) ABSTRACT

A method of treating a metal surface by application of a solution containing at least one vinyl silane and at least one bis-silyl aminosilane. A solution composition having at least one vinyl silane and at least one bis-silyl aminosilane is also provided, along with a silane coated metal surface.

15 Claims, No Drawings

SILANE COATINGS FOR METAL

The present application is a Divisional of U.S. application Ser. No. 09/356,926 filed Jul. 19, 1999 and now U.S. Pat. No. 6,827,981. The entire disclosure of which is hereby incorporated by reference.

BACKGROUND OF THE INVENTION

1. Field of the Invention

The present invention relates to silane coatings for metals. More particularly, the present invention provides coatings which include a vinyl silane and a bis-silyl aminosilane, and are particularly useful for preventing corrosion. Solutions for applying such coatings, as well as methods of treating metal surfaces, are also provided.

2. Description of Related Art

Most metals are susceptible to corrosion, including the formation of various types of rust. Such corrosion will significantly affect the quality of such metals, as well as that of the products produced therefrom. Although rust and the like may often be removed, such steps are costly and may further diminish the strength of the metal. In addition, when polymer coatings such as paints, adhesives or rubbers are applied to the metals, corrosion may cause a loss of adhesion between the polymer coating and the metal.

By way of example, metallic coated steel sheet such as galvanized steel is used in many industries, including the automotive, construction and appliance industries. In most cases, the galvanized steel is painted or otherwise coated with a polymer layer to achieve a durable and aesthetically-pleasing product. Galvanized steel, particularly hot-dipped galvanized steel, however, often develops "white rust" during storage and shipment.

White rust (also called "wet-storage stain") is typically caused by moisture condensation on the surface of galvanized steel which reacts with the zinc coating. On products such as GALVALUME®, the wet-storage stain is black in color ("black rust"). White rust (as well as black rust) is aesthetically unappealing and impairs the ability of the galvanized steel to be painted or otherwise coated with a polymer. Thus, prior to such coating, the surface of the galvanized steel must be pretreated in order to remove the white rust and prevent its reformation beneath the polymer layer. Various methods are currently employed to not only prevent the formation of white rust during shipment and storage, but also to prevent the formation of white rust beneath a polymer coating (e.g., paint).

In order to prevent white rust on hot-dipped galvanized steel during storage and shipping, the surface of the steel is often passivated by forming a thin chromate film on the surface of the steel. While such chromate coatings do provide resistance to the formation of white rust, chromium is highly toxic and environmentally undesirable. It is also known to employ a phosphate conversion coating in conjunction with a chromate rinse in order to improve paint adherence and provide corrosion protection. It is believed that the chromate rinse covers the pores in the phosphate coating, thereby improving the corrosion resistance and adhesion performance. Once again, however, it is highly desirable to eliminate the use of chromate altogether. Unfortunately, however, the phosphate conversion coating is generally not very effective without the chromate rinse.

Recently, various techniques for eliminating the use of chromate have been proposed. These include coating the galvanized steel with an inorganic silicate followed by treating the silicate coating with an organofunctional silane (U.S. Pat. No. 5,108,793). U.S. Pat. No. 5,292,549 teaches the rinsing of metallic coated steel sheet with a solution containing an organic silane and a crosslinking agent. Various other techniques for preventing the formation of white rust on galvanized steel, as well as preventing corrosion on other types of metals, have also been proposed. Many of these proposed techniques, however, are ineffective, or require time-consuming, energy-inefficient, multi-step processes. Thus, there is a need for a simple, low-cost technique for preventing corrosion on the surface of metal.

SUMMARY OF THE INVENTION

It is an object of the present invention to provide a treatment method for metal surfaces, especially to prevent corrosion.

It is another object of the present invention to provide a treatment solution useful in preventing corrosion of metal surfaces, particularly zinc, zinc alloys, and other metals having a zinc-containing coating thereon.

It is yet another object of the present invention to provide a metal surface having improved corrosion resistance.

The foregoing objects can be accomplished, in accordance with one aspect of the present invention, by a method of treating a metal surface, comprising the steps of:

(a) providing a metal surface, said metal surface chosen from the group consisting of:

a metal surface having a zinc-containing coating;

zinc; and zinc alloy; and (b) applying a silane solution to said metal surface, said silane solution having at least one vinyl silane and at least one bis-silyl aminosilane, wherein said at least one vinyl silane and said at least one bis-silyl aminosilane have been at least partially hydrolyzed.

The vinyl silane(s) may have a trisubstituted silyl group, wherein the substituents are individually chosen from the group consisting of hydroxy, alkoxy, aryloxy and acyloxy. Preferably, the vinyl silane comprises:

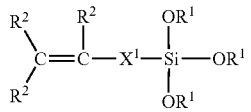

wherein:

each $R^1$ is individually chosen from the group consisting of: hydrogen, $C_1$–$C_{24}$ alkyl and $C_2$–$C_{24}$ acyl;

$X^1$ is chosen from the group consisting of: a C—Si bond, substituted aliphatic groups, unsubstituted aliphatic groups, substituted aromatic groups, and unsubstituted aromatic groups; and each $R^2$ is individually chosen from the group consisting of: hydrogen, $C_1$–$C_6$ alkyl, $C_1$–$C_6$ alkyl substituted with at least one amino group, $C_1$–$C_6$ alkenyl, $C_1$–$C_6$ alkenyl substituted with at least one amino group, arylene, and alkylarylene.

The bis-silyl aminosilane(s) may comprise an aminosilane having two trisubstituted silyl groups, wherein the substituents are individually chosen from the group consisting of hydroxy, alkoxy, aryloxy and acyloxy. Preferably, the bis-silyl aminosilane comprises:

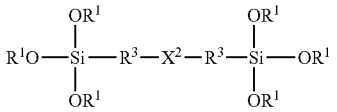

wherein:

each $R^1$ is individually chosen from the group consisting of: hydrogen, $C_1$–$C_{24}$ alkyl and $C_2$–$C_{24}$ acyl;

each $R^3$ is individually chosen from the group consisting of: substituted aliphatic groups, unsubstituted aliphatic groups, substituted aromatic groups, and unsubstituted aromatic groups; and $X^2$ is either:

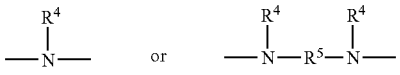

wherein each $R^4$ is individually chosen from the group consisting of: hydrogen, substituted and unsubstituted aliphatic groups, and substituted and unsubstituted aromatic groups; and $R^5$ is chosen from the group consisting of: substituted and unsubstituted aliphatic groups, and substituted and unsubstituted aromatic groups.

The present invention also provides a solution (preferably aqueous) comprising at least one vinyl silane and at least one bis-silyl aminosilane, wherein the at least one vinyl silane and the at least one bis-silyl aminosilane are at least partially hydrolyzed. A metal surface having improved corrosion resistance is also provided.

DETAILED DESCRIPTION OF THE PREFERRED EMBODIMENTS

Applicants have previously found that the corrosion of metal, particularly galvanized steel, can be prevented by applying a treatment solution containing one or more hydrolyzed vinyl silanes to the metal (see U.S. Pat. No. 5,759,629, which is incorporated herein by way of reference). While the corrosion protection provided by the resulting vinyl silane coating was surprisingly superior to conventional chromate-based treatments, and avoided the chromium disposal problem, the vinyl silane solutions of U.S. Pat. No. 5,759,629 have limited storage stability. In addition, while the methods disclosed in this patent provide excellent corrosion prevention when tested in a humidity chamber at 60° C. and 85% relative humidity ("RH"), the corrosion prevention benefits are reduced in a humidity chamber at 40° C. and 100% RH. Applicants have now found that the addition of one or more bis-silyl aminosilanes to a vinyl silane solution not only significantly improves storage stability of the solution, but also significantly improves the corrosion protection provided by the solution (particularly in tests performed at 40° C. and 100% RH).

The solutions and methods of the present invention may be used on a variety of metals, including zinc, zinc alloy, and metals having a zinc-containing coating thereon. For example, the treatment solutions and methods of the present invention are useful in preventing corrosion of steel having a zinc-containing coating, such as: galvanized steel (especially hot dipped galvanized steel), GALVALUME® (a 55%—Al/43.4%—Zn/1.6%—Si alloy coated sheet steel manufactured and sold, for example, by Bethlehem Steel Corp), GALFAN® (a 5%—Al/95%—Zn alloy coated sheet steel manufactured and sold by Weirton Steel Corp., of Weirton, W.Va.), galvanneal (annealed hot dipped galvanized steel) and similar types of coated steel. Zinc and zinc alloys are also particularly amenable to application of the treatment solutions and methods of the present invention. Exemplary zinc and zinc alloy materials include: titanium-zinc (zinc which has a very small amount of titanium added thereto), zinc-nickel alloy (typically about 5% to about 13% nickel content), and zinc-cobalt alloy (typically about 1% cobalt).

The solutions of the present invention may be applied to the metal prior to shipment to the end-user, and provide corrosion protection during shipment and storage (including the prevention of wet-storage stain such as white rust). If a paint or other polymer coating is desired, the end user may merely apply the paint or polymer (e.g., such as adhesives or rubber coatings) directly on top of the silane coating provided by the present invention. The silane coatings of the present invention not only provide excellent corrosion protection even without paint, but also provide superior adhesion of paint, rubber or other polymer layers. Thus, unlike many of the currently-employed treatment techniques, the silane coatings of the present invention need not be removed prior to painting (or applying other types of polymer coatings such as rubber).

The solutions of the present invention comprise a mixture of one or more vinyl silanes and one or more bis-silyl aminosilanes, and do not require the use or addition of silicates. The silanes in the treatment solution should be at least partially hydrolyzed, and are preferably substantially fully hydrolyzed. The solution is preferably aqueous, and may optionally include one or more compatible solvents (such as ethanol, methanol, propanol or isopropanol), as needed. The application pH of the silane mixture is generally not critical. The term "application pH" refers to the pH of the silane solution when it is applied to the metal surface, and may be the same as or different from the pH during solution preparation. Although not critical, an application pH of between about 4 and about 10 is preferred, and the pH may be adjusted by the addition of one or more acids, preferably organic acids such as acetic, formic, propionic or isopropionic. Sodium hydroxide (or other compatible base) may be used, if needed, to raise the pH of the treatment solution.

The preferred vinyl silanes which may be employed in the present invention each have a single trisubstituted silyl group, wherein the substituents are individually chosen from the group consisting of hydroxy, alkoxy, aryloxy and acyloxy. Thus, these vinyl silanes have the general formula:

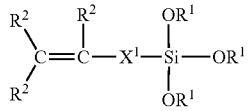

wherein each $R^1$ is chosen from the group consisting of: hydrogen, $C_1$–$C_{24}$ alkyl (preferably $C_1$–$C_6$ alkyl), and $C_2$–$C_{24}$ acyl (preferably $C_2$–$C_4$ acyl). Each $R^1$ may be the same or different, however the vinyl silane(s) is hydrolyzed in the treatment solution such that at least a portion (and preferably all or substantially all) of the non-hydrogen $R^1$ groups are replaced by a hydrogen atom. Preferably, each $R^1$ is individually chosen from the group consisting of: hydrogen, ethyl, methyl, propyl, iso-propyl, butyl, iso-butyl, sec-butyl, ter-butyl and acetyl.

$X^1$ may be a bond (specifically, a C—Si bond), a substituted or unsubstituted aliphatic group, or a substituted or unsubstituted aromatic group. Preferably, $X^1$ is chosen from the group consisting of: a bond, $C_1$–$C_6$ alkylene, $C_1$–$C_6$ alkenylene, $C_1$–$C_6$ alkylene substituted with at least one amino group, $C_1$–$C_6$ alkenylene substituted with at least one amino group, arylene, and alkylarylene. More preferably, $X^1$ is chosen from the group consisting of: a bond, and $C_1$–$C_6$ alkylene.

Each $R^2$ is individually chosen from the group consisting of: hydrogen, $C_1$–$C_6$ alkyl, $C_1$–$C_6$ alkyl substituted with at least one amino group, $C_1$–$C_6$ alkenyl, $C_1$–$C_6$ alkenyl substituted with at least one amino group, arylene, and alkylarylene. Each $R^2$ may be the same or different. Preferably, each $R^2$ is individually chosen from the group consisting of: hydrogen, ethyl, methyl, propyl, iso-propyl, butyl, iso-butyl, sec-butyl, ter-butyl and acetyl.

Particularly preferred vinyl silane(s) used to prepare the treatment solution include those having the above structure, wherein each $R^2$ is a hydrogen, $X^1$ is an alkylene (especially $C_1$–$C_{10}$ alkylene), and each $R^1$ is as described above. Exemplary vinyl silanes include: vinyltrimethoxysilane, vinyltriethoxysilane, vinyltripropoxysilane, vinyltriisopropoxysilane, vinyltributoxysilane, vinyltriisobutoxysilane, vinylacetoxysilane, vinyltriisobutoxysilane, vinylbutyltrimethoxysilane, vinylmethyltrimethoxysilane, vinylethylltrimethoxysilane, vinylpropyltrimethoxysilane, vinylbutyltriethoxysilane, and vinylpropyltriethoxysilane. Vinyltrimethoxysilane and vinyltriethoxysilane are most preferred.

The preferred bis-silyl aminosilanes which may be employed in the present invention have two trisubstituted silyl groups, wherein the substituents are individually chosen from the group consisting of hydroxy, alkoxy, aryloxy and acyloxy. Thus, these bis-silyl aminosilanes have the general structure:

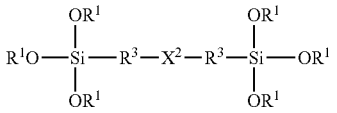

wherein each $R^1$ is as described previously. Once again the aminosilane(s) is hydrolyzed in the treatment solution such that at least a portion (and preferably all or substantially all) of the non-hydrogen $R^1$ groups are replaced by a hydrogen atom.

Each $R^3$ in the aminosilane(s) may be a substituted or unsubstituted aliphatic group, or a substituted or unsubstituted aromatic group, and each $R^3$ may be the same or different. Preferably, each $R^3$ is chosen from the group consisting of: $C_1$–$C_{10}$ alkylene, $C_1$–$C_{10}$ alkenylene, arylene, and alkylarylene. More preferably, each $R^3$ is a $C_1$–$C_{10}$ alkylene (particularly propylene).

$X^2$ may be:

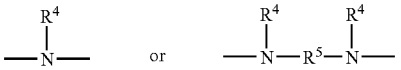

wherein each $R^4$ may be a hydrogen, a substituted or unsubstituted aliphatic group, or a substituted or unsubstituted aromatic group, and each $R^4$ may be the same or different. Preferably, each $R^4$ is chosen from the group consisting of hydrogen, $C_1$–$C_6$ alkyl and $C_1$–$C_6$ alkenyl. More preferably, each $R^4$ is a hydrogen atom.

Finally, $R^5$ in the aminosilane(s) may be a substituted or unsubstituted aliphatic group, or a substituted or unsubstituted aromatic group. Preferably, $R^5$ is chosen from the group consisting of: $C_1$–$C_{10}$ alkylene, $C_1$–$C_{10}$ alkenylene, arylene, and alkylarylene. More preferably, $R^5$ is a $C_1$–$C_{10}$ alkylene (particularly ethylene).

Particularly preferred bis-silyl aminosilanes which may be used in the present invention include:

bis-(trimethoxysilylpropyl)amine (which is sold under the tradename A-1170 by Witco):

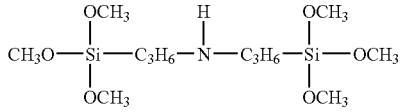

bis-(triethoxysilylpropyl)amine:

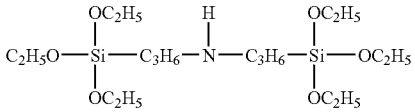

and bis-(triethoxysilylpropyl)ethylene diamine:

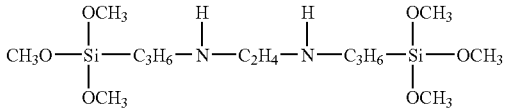

As mentioned above, the vinyl silane(s) and aminosilane (s) in the solution of the present invention are at least partially, and preferably are substantially fully hydrolyzed in order to facilitate the bonding of the silanes to the metal surface and to each other. During hydrolysis, the —$OR^1$ groups are replaced by hydroxyl groups. Hydrolysis of the silanes may be accomplished, for example, by merely mixing the silanes in water, and optionally including a solvent (such as an alcohol) in order to improve silane solubility and solution stability. Alternatively, the silanes may first be dissolved in a solvent, and water then added to accomplish hydrolysis. In order to accelerate silane hydrolysis and avoid silane condensation during hydrolysis, the pH may be maintained below about 7, more preferably between about 4 and about 6, and even more preferably between about 4.5 and about 5.0. As mentioned previously, however, the pH ranges preferred during solution preparation should not be confused with the application pH. The pH may be adjusted, for example, by the addition of a compatible organic acid, as described previously. Some silanes provide an acidic pH when mixed with water alone, and for these silanes pH adjustment may not be needed to accelerate silane hydrolysis.

It should be noted that the various silane concentrations discussed and claimed herein are all defined in terms of the ratio between the amount (by volume) of unhydrolyzed silane(s) employed to prepare the treatment solution (i.e., prior to hydrolyzation), and the total volume of treatment solution components (i.e., vinyl silanes, aminosilanes, water, optional solvents and optional pH adjusting agents). In the case of vinyl silane(s), the concentrations herein (unless otherwise specified) refer to the total amount of unhydrolyzed vinyl silanes employed, since multiple vinyl silanes may optionally be present. The aminosilane(s) concentrations herein are defined in the same manner.

As for the concentration of hydrolyzed silanes in the treatment solution, beneficial results will be obtained over a wide range of silane concentrations and ratios. It is preferred, however, that the solution have at least about 1% vinyl silanes by volume, more preferably at least about 3% vinyl silanes by volume. Lower vinyl silane concentrations generally provide less corrosion protection. Higher concentrations of vinyl silanes (greater than about 10%) should also be avoided for economic reasons, and to avoid silane condensation (which may limit storage stability). Also, treatment solutions containing high concentrations of vinyl silanes may produce thick films which are too weak or brittle for some applications.

As for the concentration of bis-silyl aminosilanes in the treatment solution, once again a wide range of concentrations are suitable. It is preferred, however, that the solution have between about 0.1% and about 5% by volume, more preferably between about 0.75% and about 3%. As for the ratio of vinyl silanes to aminosilanes, a wide range of silane ratios may be employed, and the present invention is not limited to any particular range of silane ratios. It is preferred, however, that the concentration of aminosilanes is approximately the same as or less than the concentration of vinyl silanes. More preferably, the ratio of vinyl silanes to aminosilanes is at least about 1.5, even more preferably at least about 4. While lower ratios of vinyl silanes to aminosilanes provide improvements in the stability of the treatment solution, corrosion protection is reduced. Higher ratios of vinyl silanes to aminosilanes provide improved corrosion protection, while the enhancement in solution stability provided by the aminosilanes is reduced. Applicants have found, however, that even the addition of a small amount of a bis-silyl aminosilane to the treatment solutions of U.S. Pat. No. 5,292,549 will unexpectedly improve the corrosion protection provided by the treatment solution. Therefore, while the addition of even a small amount of bis-silyl aminosilane may not appreciably improve solution stability, corrosion protection will nevertheless be enhanced. Thus, the silane ratio may be tailored to a specific need.

Since the solubility in water of some silanes suitable for use in the present invention may be limited, the treatment solution may optionally include one or more solvents (such as an alcohol) in order to improve silane solubility. Particularly preferred solvents include: methanol, ethanol, propanol and isopropanol. When a solvent is added, the amount of solvent employed will depend upon the solubility of the particular silanes employed. Thus, the treatment solution of the present invention may contain from about 0 to about 95 parts alcohol (by volume) for every 5 parts of water. Since it is often desirable to limit, or even eliminate the use of organic solvents wherever possible, the solution more preferably is aqueous in nature, thereby having less than 5 parts organic solvent for every 5 parts of water (i.e., more water than solvent). The solutions of the present invention can even be substantially free of any organic solvents. When a solvent is used, ethanol is preferred.

The treatment method itself is very simple. The unhydrolyzed silanes, water, solvent (if desired), and a small amount of acid (if pH adjustment is desired) are combined with one another. The solution is then stirred at room temperature in order to hydrolyze the silanes. The hydrolysis may take up to several hours to complete, and its completion will be evidenced by the solution becoming clear.

In one exemplary method of preparing the treatment solution, the aminosilane(s) is first hydrolyzed in water, and acetic acid may be added as needed to adjust the pH to below about 7. After addition of the aminosilane, the treatment solution is mixed for about 24 hours to ensure complete (or substantially complete) hydrolysis. Thereafter, the vinyl silane(s) is added to the treatment solution while stirring to ensure complete (or substantially complete) hydrolysis of the vinyl silane(s).

The metal surface to be coated with the solution of the present invention may be solvent and/or alkaline cleaned by techniques well-known to those skilled in the art prior to application of the treatment solution of the present invention. The silane solution (prepared in the manner described above) is then applied to the metal surface (i.e., the sheet is coated with the silane solution) by, for example, dipping the metal into the solution (also referred to as "rinsing"), spraying the solution onto the surface of the metal, or even brushing or wiping the solution onto the metal surface. Various other application techniques well-known to those skilled in the art may also be used. When the preferred application method of dipping is employed, the duration of dipping is not critical, as it generally does not significantly affect the resulting film thickness. It is merely preferred that whatever application method is used, the contact time should be sufficient to ensure complete coating of the metal. For most methods of application, a contact time of at least about 2 seconds, and more preferably at least about 5 seconds, will help to ensure complete coating of the metal.

After coating with the treatment solution of the present invention, the metal sheet may be air-dried at room temperature, or, more preferably, placed into an oven for heat drying. Preferable heated drying conditions include temperatures between about 20° C. and about 200° C. with drying times of between about 30 seconds and about 60 minutes (higher temperatures allow for shorter drying times). More preferably, heated drying is performed at a temperature of at least about 90° C., for a time sufficient to allow the silane coating to dry. While heated drying is not necessary to achieve satisfactory results, it will reduce the drying time thereby lessening the likelihood of the formation of white rust during drying. Once dried, the treated metal may be shipped to an end-user, or stored for later use.

The coatings of the present invention provide significant corrosion resistance during both shipping and storage. It is believed that the vinyl silane(s) and aminosilane(s) form a dense, crosslinked polymer coating on the metal, and that the aminosilane(s) crosslinks not only itself but also the vinyl silane(s). The result is a coating comprising the vinyl silane(s) and the aminosilane(s) which provides the desired corrosion resistance. In addition, and just as significant, this coating need not be removed prior to painting or the application of other polymer coatings. For example, the end-user, such as an automotive manufacturer, may apply paint directly on top of the silane coating without additional treatment (such as the application of chromates). The silane coating of the present invention not only provides a surprisingly high degree of paint adhesion, but also prevents delamination and underpaint corrosion even if a portion of the base metal is exposed to the atmosphere. The coated surface of the metal, however, should be cleaned prior to application of paint or other polymer coating. Suitable polymer coatings include various types of paints, adhesives (such as epoxy automotive adhesives), and peroxide-cured rubbers (e.g., peroxide-cured natural, NBR, SBR, nitrile or silicone rubbers). Suitable paints include polyesters, polyurethanes and epoxy-based paints. Thus, not only do the coatings of the present invention prevent corrosion, they may also be employed as primers and/or adhesive coatings for other polymer layers.

The examples below demonstrate some of the superior and unexpected results obtained by employing the methods of the present invention.

EXAMPLES

The various silane solutions described in the table below were prepared by mixing the indicated silanes with water, solvent (where indicated), and acetic acid (if needed to provide the indicated pH during solution preparation). Panels of hot-dipped galvanized steel ("HDG") were then solvent-cleaned, alkaline-cleaned, water rinsed, dipped into the treatment solution for approximately 1 minute, and then air-dried at 120° C. for about 5 minutes.

In order to simulate the conditions experienced by HDG during storage and shipment, the treated HDG panels were then subjected to a "stack test" and a "salt spray test." In the stack test, three coated panels were wetted with water, clamped to one another in a stack, and then placed in a humidity chamber at 100° F. and 100% RH. Interfacing surfaces of the panels (i.e., surfaces which contacted another panel) were monitored each day for the presence of white rust, and were rewet with water each day. The salt spray test comprised ASTM-B117. The following results were observed (including results for untreated (alkaline-cleaned only) panels and panels treated with a standard phosphate conversion coating and chromate rinse:

| Silane(s) | Solvent (in addition to water) | pH of treatment solution | White rust coverage after 14 day stack test | White rust coverage after 24 hour salt spray test |
|---|---|---|---|---|
| Untreated | — | — | >10% | >10% |
| Chromated | — | — | <10% | <10% |
| 5% VS | None | 4 | >10% | >10% |
| 5% MS | None | 4 | >10% | >10% |
| 5% BTSE | 30% Ethanol | 6 | >10% | >10% |
| 3% A-1170 | None | 6 | >10% | >10% |
| 4% BTSE + 2% VS | 24% Ethanol | 3 | >10% | >10% |
| 2% BTSE + 3% MS | 12% Ethanol | 6 | >10% | >10% |
| 3% VS + 2% A-1170 (1.5:1) | None | 4.5–5.0 | 35.0 | <10% |
| 4% VS + 2% A-1170 (2:1) | None | 4.5–5.0 | 25.0 | <10% |
| 3.7% VS + 1.2% A-1170 (3:1) | None | 4.5–5.0 | 13.5 | <10% |
| 4% VS + 1% A-1170 (4:1) | None | 4.5–5.0 | 6.3 | <10% |
| 4.2% VS + 0.8% A-1170 (5:1) | None | 4.5–5.0 | 3.3 | <10% |
| 4.3% VS + 0.7% A-1170 (6:1) | None | 4.5–5.0 | 2.5 | <10% |
| 4.4% VS + 0.6% A-1170 (7:1) | None | 4.5–5.0 | 2.1 | <5% |
| 4.44% VS + 0.56% A-1170 (8:1) | None | 4.5–5.0 | 1.7 | <5% |
| 4.5% VS + 0.5% A-1170 (9:1) | None | 4.5–5.0 | 0.8 | <5% |

VS = vinyltrimethoxysilane
MS = methyltrimethoxysilane
BTSE = 1,2-bis-(triethoxysilyl) ethane
A-1170 = bis-(trimethoxysilylpropyl) amine Solution stability was monitored by visual observation. Any turbidity or gelling of the solution is an indication that the silanes are condensing, and therefore the effectiveness of the silane solution is degraded. The silane solution comprising 5% VS (as described in Table 1 above) exhibited gelling within three days after solution preparation. In contrast, the solution comprising 4% VS and 1% A-1170 exhibited no gelling or turbidity two weeks after the solution had been prepared, thereby indicating that the addition of the bis-silyl aminosilane significantly improved solution stability while also improving corrosion protection. While higher ratios of vinyl silane to bis-silyl aminosilane further improve corrosion protection, applicants have found that improvements in solution stability are diminished. Thus, for example, the improved solution stability allows the silane solutions of the present invention to be used several days (or even longer) after the solution is first prepared.

The foregoing description of preferred embodiments is by no means exhaustive of the variations in the present invention that are possible, and has been presented only for purposes of illustration and description. Numerous modifications and variations will be apparent to those skilled in the art in light of the teachings of the foregoing description without departing from the scope of this invention. For example, various types of polymer coatings other than paint may be applied on top of the silane coating of the present invention. In addition, vinyltrimethoxysilane and bis-(trimethoxysilylpropyl) amine are merely exemplary silanes which may be employed. Thus, it is intended that the scope of the present invention be defined by the claims appended hereto.

We claim:

1. An aqueous solution comprising at least one vinyl silane and at least one bis-silyl aminosilane, wherein said at least one vinyl silane and said at least one bis-silyl aminosilane are at least partially hydrolyzed, and wherein the bis-silyl aminosilane comprises:

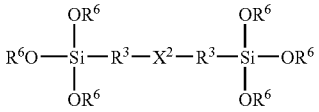

wherein:

each $R^6$ is individually chosen from the group consisting of: hydrogen and $C_1$–$C_{24}$ alkyl;

each $R^3$ is individually chosen from the group consisting of: substituted aliphatic groups, unsubstituted aliphatic groups, substituted aromatic groups, and unsubstituted aromatic groups; and $X^2$ is either:

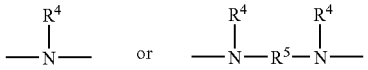

wherein each $R^4$ is hydrogen; and $R^5$ is chosen from the groups consisting of: substituted and unsubstituted aliphatic groups, and substituted and unsubstituted aromatic groups; and wherein the ratio (by volume) of the total concentration of vinyl silanes to the total concentration of bis-silyl aminosilanes in said silane solution is greater than 5; and wherein the total concentration of bis-silyl aminosilanes in said solution is between about 0.1% and 0.75%.

2. The solution of claim 1, wherein said vinyl silane has a trisubstituted silyl group, wherein the substituents are individually chosen from the group consisting of hydroxy, alkoxy, aryloxy and acyloxy.

3. The solution of claim 2, wherein said vinyl silane comprises:

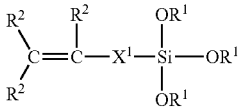

wherein:

each $R^1$ is individually chosen from the group consisting of: hydrogen, $C_1$–$C_{24}$ alkyl and $C_2$ –$C_{24}$ acyl;

$X^1$ is chosen from the group consisting of: a C—Si bond, substituted aliphatic groups, unsubstituted aliphatic groups, substituted aromatic groups, and unsubstituted aromatic groups; and each $R^2$ is individually chosen from the group consisting of: hydrogen, $C_1$–$C_6$ alkyl, $C_1$–$C_6$ alkyl substituted with at least one amino group, $C_1$–$C_6$ alkenyl, $C_1$–$C_6$ alkenyl substituted with at least one amino group, arylene, and alkylarylene.

4. The solution of claim 3, wherein each $R^1$ is individually chosen from the group consisting of: hydrogen, ethyl, methyl, propyl, iso-propyl, butyl, iso-butyl, sec-butyl, ter-butyl and acetyl.

5. The solution of claim 3, wherein $X^1$ is chosen from the group consisting of: a C—Si bond, $C_1$–C6 alkylene, $C_1$–C6 alkenylene, C1 - C6 alkylene substituted with at least one amino group, $C_1$–$C_6$ alkenylene substituted with at least one amino group, arylene, and alkylarylene.

6. The solution of claim 3, wherein each $R^2$ is individually chosen from the group consisting of: hydrogen, ethyl, methyl, propyl, iso-propyl, butyl, iso-butyl, sec-butyl, ter-butyl and acetyl.

7. The solution of claim 1, wherein each $R^6$ is individually chosen from the group consisting of: hydrogen, ethyl, methyl, propyl, iso-propyl, butyl, iso-butyl, sec-butyl, ter-butyl and acetyl.

8. The solution of claim 7, wherein each $R^3$ is individually chosen from the group consisting of: $C_1$–$C_{10}$ alkylene, $C_1$–$C_{10}$ alkenylene, arylene, and alkylarylene.

9. The solution of claim 1, wherein $R^5$ is chosen from the group consisting of: $C_1$–$C_{10}$ alkylene, $C_1$–$C_{10}$ alkenylene, arylene, and alkylarylene.

10. The solution of claim 1, wherein said bis-silyl aminosilane is chosen from the group consisting of: bis-(trimethoxysilylpropyl)amine, bis-(triethoxysilylpropyl)amine, and bis-(triethoxysilylpropyl)ethylene diamine.

11. The solution of claim 1, wherein said vinyl silane is chosen from the group consisting of: vinyltrimethoxysilane, vinyltriethoxysilane, vinyltripropoxysilane, vinyltriisopropoxysilane, vinyltributoxysilane, vinyltriisobutoxysilane, vinylacetoxysilane, vinyltriisobutoxysilane, vinylbutyltrimethoxysilane, vinylmethyltrimethoxysilane, vinylethylltrimethoxysilane, vinylpropyltrimethoxysilane, vinylbutyltriethoxysilane, and vinylpropyltriethoxysilane.

12. The solution of claim 1, wherein the total concentration of vinyl silanes in said solution is at least about 1%.

13. The solution of claim 12, wherein the total concentration of vinyl silanes in said solution is at least about 3%.

14. A silane coated metal surface, comprising:

(a) a metal surface chosen from the group consisting of: a metal surface having a zinc-containing coating;

zinc; and zinc alloy; and (b) a silane coating bonded to said metal surface, said coating comprising at least one vinyl silane and at least one bis-silyl aminosilane, wherein said at least one vinyl silane and said at least one bis-silyl aminosilane are at least partially hydrolyzed, and wherein the bis-silyl aminosilane comprises:

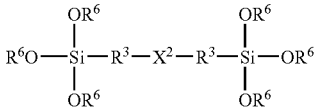

wherein:

each $R^6$ is individually chosen from the group consisting of: hydrogen and $C_1$–$C_{24}$ alkyl;

each $R^3$ is individually chosen from the group consisting of: substituted aliphatic groups, unsubstituted aliphatic groups, substituted aromatic groups, and unsubstituted aromatic groups; and $X^2$is either:

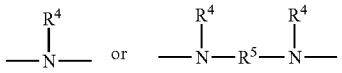

wherein each $R^4$ is hydrogen; and $R^5$ is chosen from the groups consisting of: substituted and unsubstituted aliphatic groups, and substituted and unsubstituted aromatic groups; and wherein the ratio (by volume) of the total concentration of vinyl silanes to the total concentration of bis-silyl aminosilanes in said silane solution is greater than 5; and wherein the total concentration of bis-silyl aminosilanes in said solution is between about 0.1% and 0.75%.

15. The metal surface of claim 14, wherein said metal surface comprises hot-dipped galvanized steel.

* * * * *